US006006554A

United States Patent [19]

Gallagher

[11] Patent Number: 6,006,554

[45] Date of Patent: Dec. 28, 1999

[54] TWO STAGE COUNTER CURRENT DRUM WASHER

[75] Inventor: Brian James Gallagher, Litchfield, N.H.

[73] Assignee: Beloit Technologies, Inc., Wilmington, Del.

[21] Appl. No.: 09/089,339

[22] Filed: Jun. 3, 1998

[51] Int. Cl.[6] ..... D06B 5/02

[52] U.S. Cl. ..... 68/181 R; 68/184; 210/404; 210/416.1; 210/429; 162/321; 162/363

[58] Field of Search ..... 210/210, 211, 210/215, 216, 297, 327, 409, 411, 404, 416.1, 429, 418, 430; 8/156; 68/181 R, 184, 43; 162/321, 363, 60

[56] References Cited

U.S. PATENT DOCUMENTS

| | | |
|---|---|---|
| 2,963,158 | 12/1960 | Jung . |
| 3,096,280 | 7/1963 | Davis et al. . |
| 3,363,770 | 1/1968 | Luthi . |
| 3,630,380 | 12/1971 | Barnebl et al. . |
| 3,680,708 | 8/1972 | Luthi . |
| 3,794,178 | 2/1974 | Luthi . |
| 3,823,830 | 7/1974 | Hayafune . |
| 3,837,499 | 9/1974 | Luthi . |
| 4,157,301 | 6/1979 | Wegener . |
| 4,168,234 | 9/1979 | Hutto, Jr. . |
| 4,217,170 | 8/1980 | Luthi . |
| 4,276,169 | 6/1981 | Browne et al. . |
| 4,292,123 | 9/1981 | Lintune et al. . |
| 4,370,231 | 1/1983 | Lavalley . |
| 4,419,165 | 12/1983 | Lavalley . |
| 4,502,171 | 3/1985 | Koskinen et al. . |
| 4,683,059 | 7/1987 | Lavalley . |
| 4,827,741 | 5/1989 | Luthi . |
| 5,046,338 | 9/1991 | Luthi . |
| 5,281,343 | 1/1994 | Lewis et al. . |
| 5,308,488 | 5/1994 | Nelson . |
| 5,460,019 | 10/1995 | Ojala et al. . |
| 5,480,545 | 1/1996 | Lewis . |
| 5,683,582 | 11/1997 | Luthi . |
| 5,842,242 | 12/1998 | Antkowiak . |

OTHER PUBLICATIONS

"IMPCO Coru–Dek™ Vacuum Washers"—Beloit Corporation, 1996.

Seven Beloit View Graphs—Admitted Prior Art.

*Primary Examiner*—Frankie L. Stinson

[57] ABSTRACT

Paper fiber suspended in black liquor is washed in a rotating drum divided into a plurality of adjacent sectors. The fiber is formed into a mat on the drum, and the drum is rotated so the sectors progress through a first wash and a second wash of progressively cleaner wash fluid. Each sector has two distinct drainage systems. One drainage system drains the first wash water after it has passed through the mat, and is then blocked while that sector passes through the second wash. The cleaner second wash fluid is thus kept separate from the more contaminated first wash fluid, and is recirculated to be used in subsequent cycles as first wash fluid.

10 Claims, 6 Drawing Sheets

TWO STAGE COUNTER CURRENT DRUM WASHER

FIELD OF THE INVENTION

The present invention relates to pulp washers in general and to drum washers used to remove black liquor in particular.

BACKGROUND OF THE INVENTION

Paper is principally manufactured from wood fibers. Two broad types of papermaking stock are used: mechanical pulp created by abrading raw wood to separate fibers, and chemical pulps which are produced by digesting wood chips in chemical liquor which dissolves the lignin which binds the wood fibers together.

The output from a chemical digester is a high consistency stock of fibers suspended in a solution containing dissolved lignin and digesting liquids often containing alkaline chemicals. Before further processes can be performed on the fibers separated from the wood chips the dissolved lignin and digesting chemicals, referred to as black liquor, must be separated from the fibers. To minimize downstream problems, and the production of undesirable waste products, the better than 99 percent of the black liquor must be separated from the fibers. The process of separating the dissolved lignin and digesting chemicals is referred to as the washing process.

The process is complicated by a need to minimize the dilution of the black liquor during the washing process. Dilution must be minimized because after separation of the fiber, the black liquor and all wash water are distilled and the residue is burnt to produce energy and ash. The ash, referred to as smelt, contains an alkaline residue which is processed to create the digesting liquor thus completing the digestion cycle by recycling the chemicals used to digest the lignin in the wood chips.

A paper manufacturing plant may produce 1,500 gallons per minute or more of black liquor wash water. Even with multistage distillation the energy demands for processing this quantity of liquid are high. To maximize washing effectiveness, while at the same time minimizing the amount of water used, counterflow washing is used.

Counterflow is an engineering technique wherein two process streams interact as they move in opposite directions. As applied to pulp washing this means a series of washers is set up with the final wash being performed with clean water. The waste water from the last washer is then used to wash the stock in the second from the last washer. Water from the second to last washer is used to wash stock in a third to last washer and so on for the total number of washers used.

The typical washer used by industry is a rotating cylinder which has a filter wire or cloth wrapped around the cylindrical surface. The rotating cylinder is submerged in a container of fiber stock typically having a consistency of about one percent. Vacuum is drawn on the inside surface of the cylinder drawing liquid through the filter and forming a fiber mat on the outside of the cylinder. Alternatively the rotating cylinder and fiber container are enclosed in a pressurized container and the interior of the cylinder is vented to draw stock through the filter.

The filter cloth or wire is supported on a corrugated deck. The cylindrical filter surface is divided into sections along the circumference of the cylinder, so that the vacuum drawn on a particular section can be turned off to allow the fiber mat to be removed from the filter surface. The division of the cylindrical surface into sections is accomplished by baffles which extend between sections. The drum has an inner cylindrical shell which is spaced from the corrugated deck forming a radially and axially extending space between the corrugated deck and the inner cylindrical shell. This space is divided by radial baffles into drainage sectors, one for each filter section.

Each sector drains down to the axis of the cylinder to a valve housing referred to as a grapefruit. At the grapefruit a stationary valve member controls which sectors are supplied with vacuum and which are not. Black liquor and/or wash water is drawn through a hollow shaft in the middle of the trunnion, or bearing supporting rotation of the drum. The hollow shaft connects to radially extending tubes which connect with each drainage sector. The drainage sectors in turn draw liquid through small openings called drainage louvers in the corrugated deck.

The liquid extracted from inside the drum is used to dilute the incoming pulp from the digester which has a consistency of 12–16 percent down to the one percent necessary to form a uniform fiber mat on the cylinder surface. A portion of the liquid extracted from the first washer is sent to the evaporators. Logically, the flow of black liquor and wash water sent to the evaporators is substantially equal to the volume of the wash water because the consistency of the pulp entering and leaving the washers is substantially the same. For a perfect washer therefore, the black liquor would not be diluted at all and would only be displaced by the wash water. Practical systems may result in the black liquor being diluted only twenty to thirty percent by the addition of wash water. Each subsequent washer utilizes the liquid extracted to dilute the incoming stock with the remaining stock flowing back to the previous washer. Typically three or four washers are required to adequately clean the black liquor from the digested pulp.

A number of approaches have been attempted to perform more than one washing step on a single washer.

One approach is to use a Fourdrinier washer where a continuous wire or forming fabric similar to that used to form a paper web is used. This approach is workable but requires typically five to seven wash stages because of the tendency for wash water flowing through the fiber mat to form paths of lower resistance, known as channeling, so that each step is less effective.

Reducing the total number of washer units from three or four units to two units would result in considerable cost savings. There is cost savings both in reduced capital and facility costs and maintenance and operating costs. What is needed is a cylindrical brown stock washer which can perform two washing steps on a single machine.

SUMMARY OF THE INVENTION

The drum washer of this invention employs two liquid drain systems which are connected to each individual sector of the washer drum. Each sector has a portion of the cylindrical surface of the drum with an outermost positioned filter screen which extends the axial length of the drum and extends along a short portion of the circumference. A corrugated deck supports the screen in each sector, and each sector is isolated from every other sector so that liquid from a particular sector can only drain through the underlying corrugated deck. Beneath the corrugated deck are positioned an inner cylindrical shell and a plurality of radially and axially extending baffles which create drainage passageways. Two drainage passageways are created below each sector of the drum washer. Each of the two drainage passageways is connected to the same corrugated deck by drainage louvers which extend axially along the cylindrical deck surface.

The washer drum rotates within a container of one percent paper fiber stock suspended in black liquor produced by the digestion process. A mat of fibers forms on the rotating cylindrical surface. Two successive wash zones defined by first and second wash showers. As the drum rotates through the mat formation zone and the first wash zone, vacuum is Through the first of the two drainage passageways formed beneath each sector.

Liquid drawn from the first drainage system is used to dilute stock from the digester, which has a consistency of 12–14 percent, to the washer consistency of one percent, with excess liquid going to evaporators for concentration and burning. As the washer drum rotates under the second washing zone, the first drainage system is closed off from the vacuum drain, and liquid is drawn through the second drainage system through a second vacuum drain. Liquid taken the second drainage system is used to supply wash water to the first wash zone. As a washer drum sector continues to rotate it passes through a fiber removal zone where the fiber is removed from the drum. Both drainage systems are closed as the sectors pass through the fiber removal zone, allowing the fiber mat to be doctored off the cylindrical filter surface.

As the cylinder rotates once again into the stock supply, only the first drainage system is connected to its vacuum drain. The first drainage system then draws liquid through the drum surface again forming a fiber mat. Because the second drainage system is only drawing liquid from the drum surface during the second wash there is little or no mixing of liquid from the second wash with liquid from the first washing zone. The second drainage system remains filled with second wash zone liquid during the rotation of the drum through the mat formation zone and the first wash zone.

It is a feature of the present invention to wash chemically produced pulp with less washer equipment.

It is a further feature of the present invention to improve the washing capability of a single drum washer.

It is a yet further feature of the present invention to provide a method of counterflow washing paper pulp stock on a single washer drum.

Further objects, features and advantages of the invention will be apparent from the following detailed description when taken in conjunction with the accompanying drawings.

DESCRIPTION OF THE PREFERRED EMBODIMENT

Figure 1:
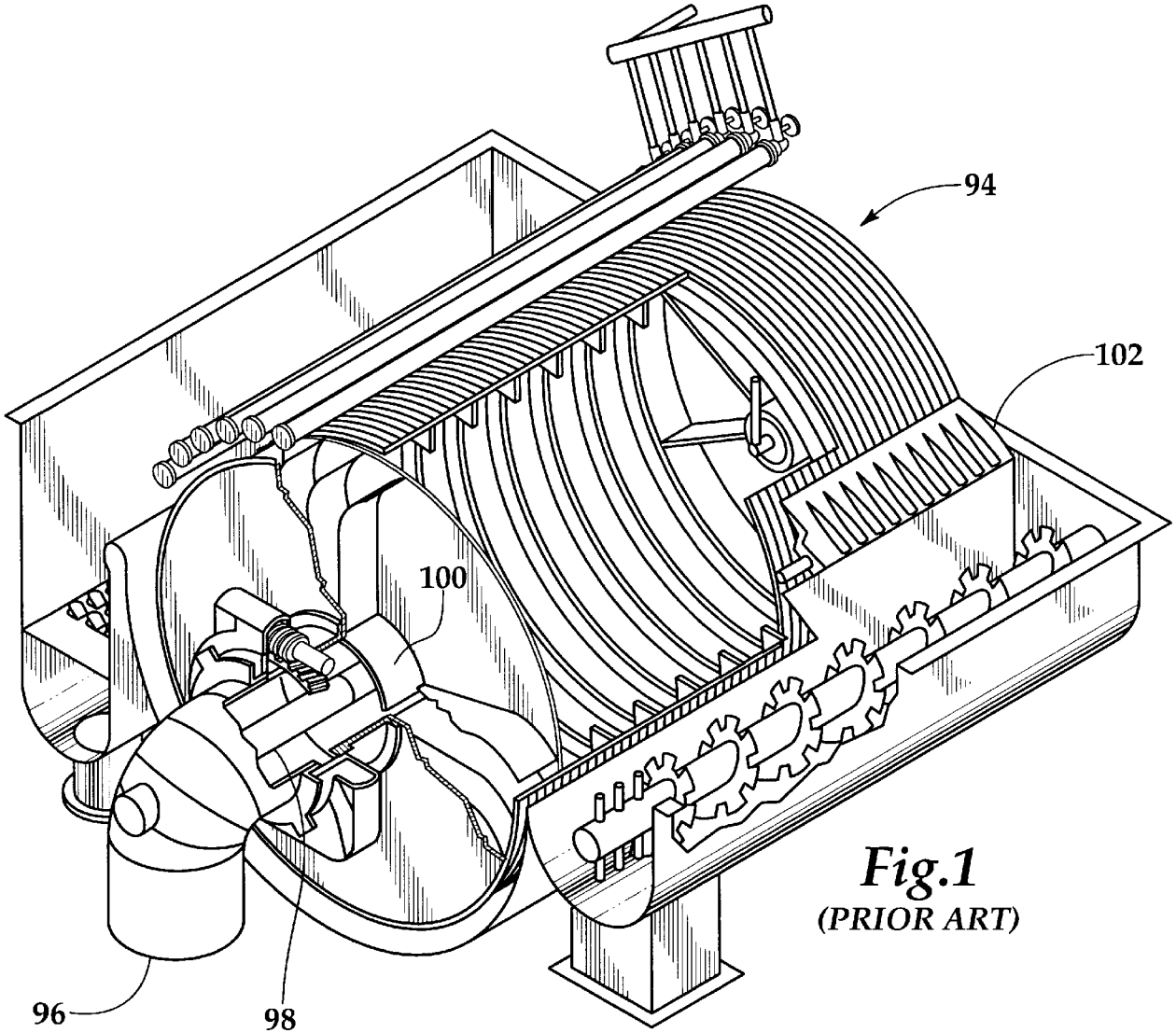
Fig.1 (PRIOR ART)
FIG. 1 is an cut-away perspective view of a prior art pulp washer.
Figure 2:
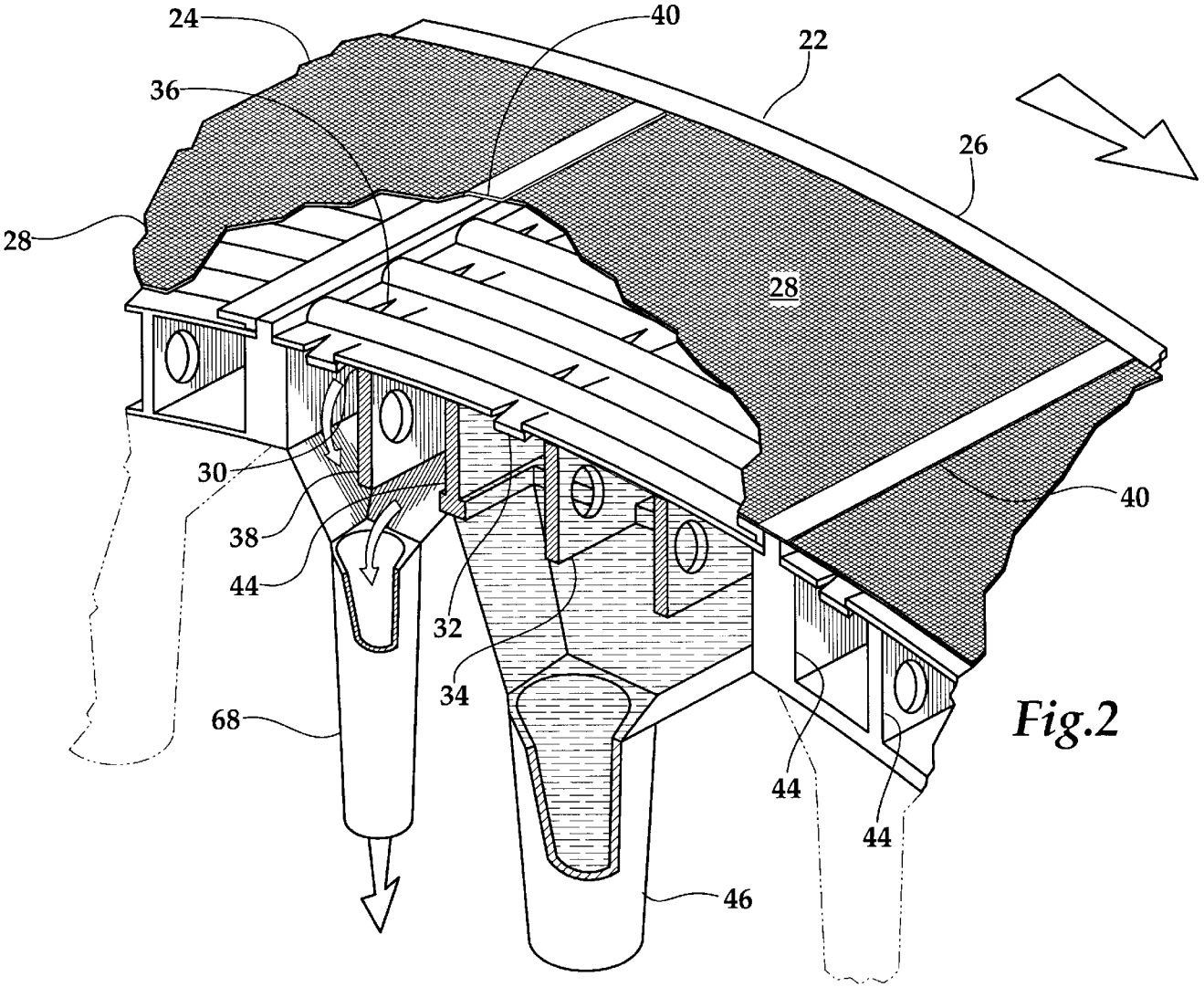
FIG. 2 is a fragmentary perspective view of a portion of the washer drum of the drum washer of this invention.
Figure 3:
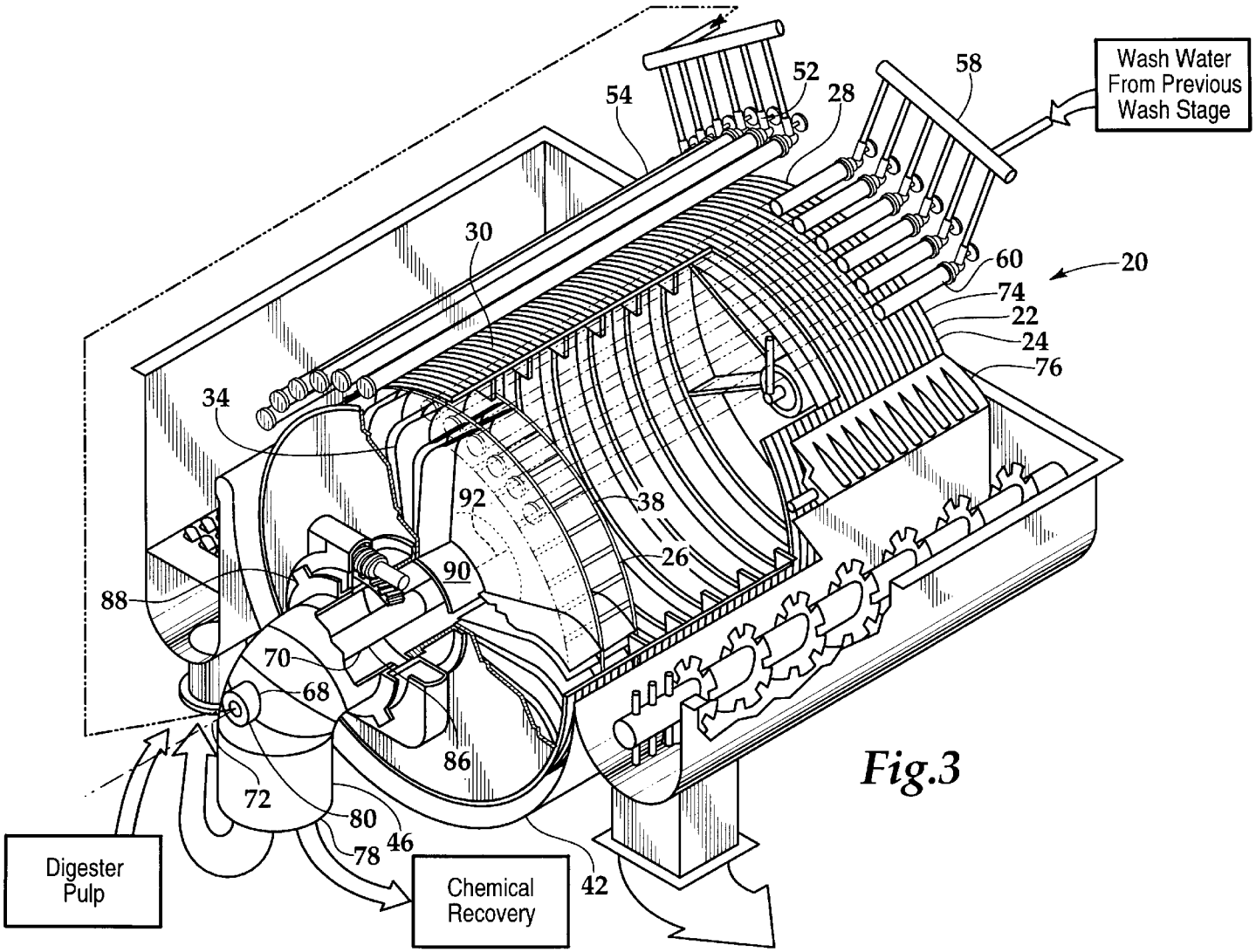
FIG. 3 is a cut-away perspective view of the pulp washer of FIG. 2 with the fluid flows shown schematically.

Referring more particularly to FIGS. 1–6 wherein like numbers refer to similar parts, a pulp drum washer 20 is shown in FIG. 3. The pulp washer 20 employs a rotatable cylindrical drum 22 which has a cylindrical surface 24. The drum 22 is divided into sectors 26 as shown in FIG. 2. A filter screen 28 defines the uppermost layer of each drum sector 26, with the screen-covered sectors forming adjacent filter sections. Each filter screen 28 section is supported on a corrugated deck 30. A first series of outwardly facing holes 32 or drainage louvers are defined in the deck 30. The deck holes receive fluid which passes through the filter screen and drain into first axially extending fluid collection passageways 34. The deck 30 has a second series of holes 36 which drain into second axially extending fluid collection passageways 38. Communication of liquid between sectors is prevented by seals 40 between adjacent sectors 26. Communication between the first fluid collection passageways 34 and the second fluid collection passageways 38 is prevented by axially and radially extending baffles 44 which form the fluid collection passageways.

The drum 22 is immersed in a container 42 which is supplied with pulp from a chemical pulp digester as shown in FIG. 3. Typically the pulp from a digester has a consistency of twelve to sixteen percent fiber. The fiber is suspended in a black liquor which contains dissolved lignin from the digested wood chips. The black liquor also contains alkaline or similar chemicals used to extract the lignin from the raw wood chips.

Before the pulp can be further processed, it is necessary to remove the dissolved organic materials and the digesting chemicals from the pulp. Because of the sensitivity of bleaching chemistry used in subsequent processing steps it is desirable to remove considerably better then ninety-nine percent of the digesting chemicals and dissolved organic material from the pulp.

After the black liquor containing digesting chemicals and dissolved organic material is separated from the fiber, the liquor is concentrated by multistage distillation and the residue is burnt for its fuel content and to allow recovery of smelt containing alkaline residues which are processed to create the digesting liquor.

Figure 4:
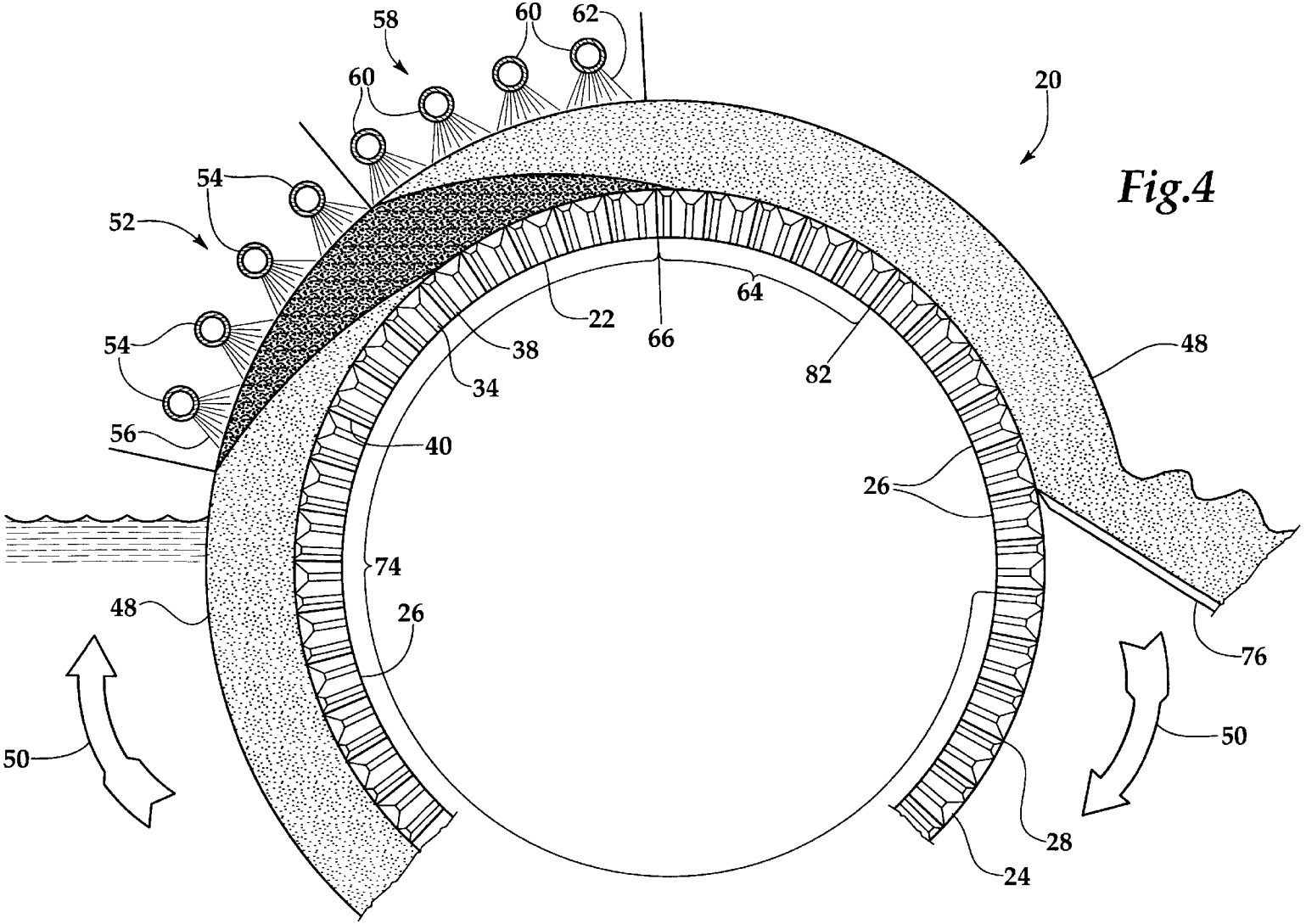
FIG. 4 is a schematic view of the fluid exchange within the drum of the pulp washer of FIG. 2.

The infed pulp from the digester is diluted to about one percent fiber by weight with black liquor and spent wash water which is collected from the first fluid collection system 46 which drains the first fluid collection passageways 34. As shown in FIG. 4, as the drum rotates through the pulp, a fiber mat 48 is formed on the surface of the cylindrical drum 22. FIG. 4 is schematic and the thickness of the fiber mat in relation to the drum 22 has been greatly exaggerated. The low concentration of fiber and the stock supplied to the washer 20 produces a uniform fiber mat without clumps. A vacuum is drawn on the first fluid collection system 46 which draws liquid from the stock contained in the container 42 to form the mat 48. As the drum 22 rotates, as indicated by arrows 50, portions of the surface 24 of the drum 22 leave the liquid stock, where the fiber mat 48 stops increasing in thickness and begins to dewater.

A first washer 52, shown in FIG. 3, is composed of a number of individual wash fluid supply tubes 54 which direct sprays of wash fluid 56 against the mat 48 on the drum surface 24 as it passes below. FIG. 4 illustrates how the first wash fluid 56 penetrates the fiber mat 48, thereby displacing the black liquor with which the fiber mat is saturated. A second washer 58 which is likewise composed of a number of wash fluid supply tubes 60 directs sprays of a second, and cleaner, wash fluid 62 against the fiber mat 48 on the drum surface 24 just downstream of the first washer 52. Wash fluid from the second washer 58 penetrates the fiber mat 48, displacing the wash fluid 56 supplied by the first washer 52.

Because of the considerable cost in distilling the black liquor sent to the boilers to be burned, the total amount of wash water is ideally equal to the water contained in the fiber mat 48 as formed on the drum 22. Although practical dilution ratios may require twenty to thirty percent more dilution water. High removal rates are achieved by passing the same wash water through the fiber mat 48 in a counter-current flow to the direction of the fiber mat as it progresses through one or more pulp washers 20. Thus the wash fluid 56 for the first washer 52 is collected on the underside of the filter screen 28 as the wash fluid from the second washer penetrates the filter screens 28 as shown in FIG. 3 along the sectors in the region labeled 64. Clean separation between collecting the second wash fluid 62, which contains considerably less dissolved material than the first wash fluid 56, has historically posed a problem.

The problem is caused by the mixing of the fluid used in the first wash with the fluid used in the second wash in the drainage system that collects wash fluid which passes through the fiber mat. In FIG. 4 there is a point 66 at which second wash fluid 62 begins to penetrate the filter screen 28. To prevent this fluid mixing with the wash fluid already contained in the first fluid collection system 46, a second fluid collection system 68 which connects and drains the second fluid collection passageways 38 is used. Switching from one system to the other must be accomplished as close to the filter screen 28 as possible. This switching is accomplished by a valve mechanism 70 positioned along the axis 72 of the cylindrical drum 22.

The valve mechanism 70 is arranged to connect the first drainage system 46 with a source of vacuum 78 along a portion 74 of the drum which extends from shortly after a doctor blade 76 which removes the fiber mat to the point 66 where the second wash fluid 62 begins to penetrate the fiber mat 48. The valve mechanism 70 closes the first drainage system from the point 66 until after the fiber mat has been removed by the doctor blade 76 and the filter screen 28 is again submerged in stock from which a new fiber mat 48 is formed.

The valve mechanism 70 is also designed to connect the second drainage system 68 to a second source of vacuum 80 along a region 64 extending from the point 66 where the second wash fluid penetrates the fiber mat 48 to a point 82 spaced upstream from the doctor blade 76. Along the rest of the drum surface 24 the valve mechanism 70 closes the second fluid collection system 68, preventing any fluid from entering or leaving the collection system 68. Atmospheric pressure prevents fluid from draining out the holes 36 which connect the second drainage system 68 with the outer surface 84 of the corrugated deck 30. Thus, because there are two separate drainage systems which communicate directly with the corrugated deck 30, valving between the systems effectively takes place at the corrugated deck surface 84.

Figure 5:
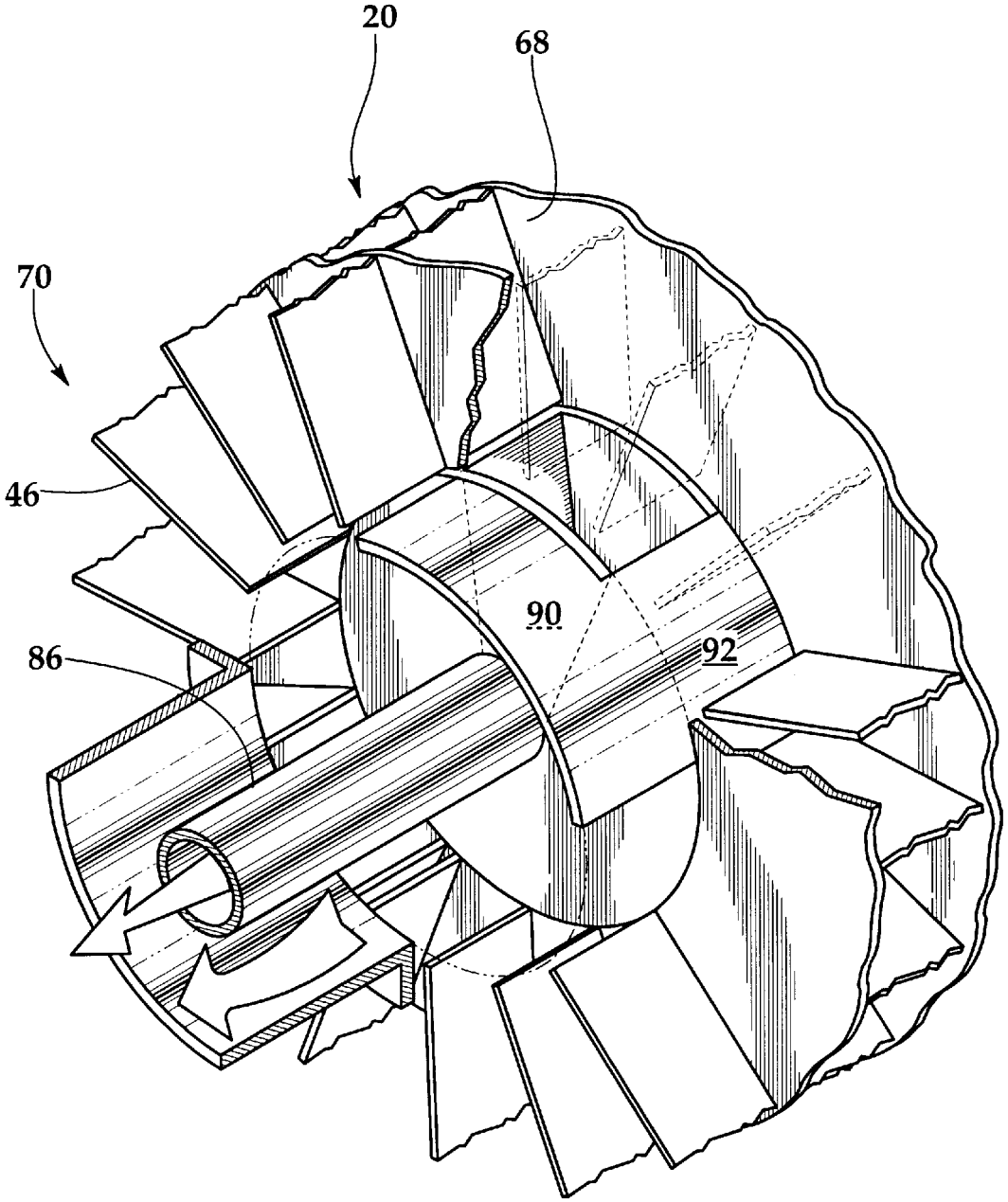
FIG. 5 is a fragmentary isometric view of an alternative axial valve arrangement in the pulp washer of FIG. 3.

As shown in FIG. 5, the valve mechanism 70 will typically have a non-moving valve stem 86 which is supported through a trunnion 88 which supports the rotating drum 22. The valve stem 86 has a first sealing surface 90 which blocks flow from a selected portion of the first fluid collection system 46. The valve stem 86 has a second sealing surface 92 which blocks flow from a selected portion of the second fluid collection system 68. The valve 70 is arranged so that both fluid collection systems are closed shortly before the fiber mat 48 reaches the doctor blade 76 so that the mat may be easily separated from the screen 28.

The pulp washer 20 will typically be used in groups of two arranged in series so that the pulp is subjected to four washing cycles. When two pulp washers 20 are employed the second washer will use fresh water as the fourth wash fluid. The fourth wash fluid will be collected and used as the third wash fluid which will be collected and in part be used to dilute the fiber collected from the first washer and in part to form the second wash fluid 62.

A prior art washer 94 is shown in FIG. 1. The prior art washer 94 has a single drainage system 96 and employs a valve stem 98 with a single sealing surface 100 which controls drainage from the drainage system 96 so that vacuum is drawn at all times except for a selected region in front of the doctor blade 102.

Figure 6:
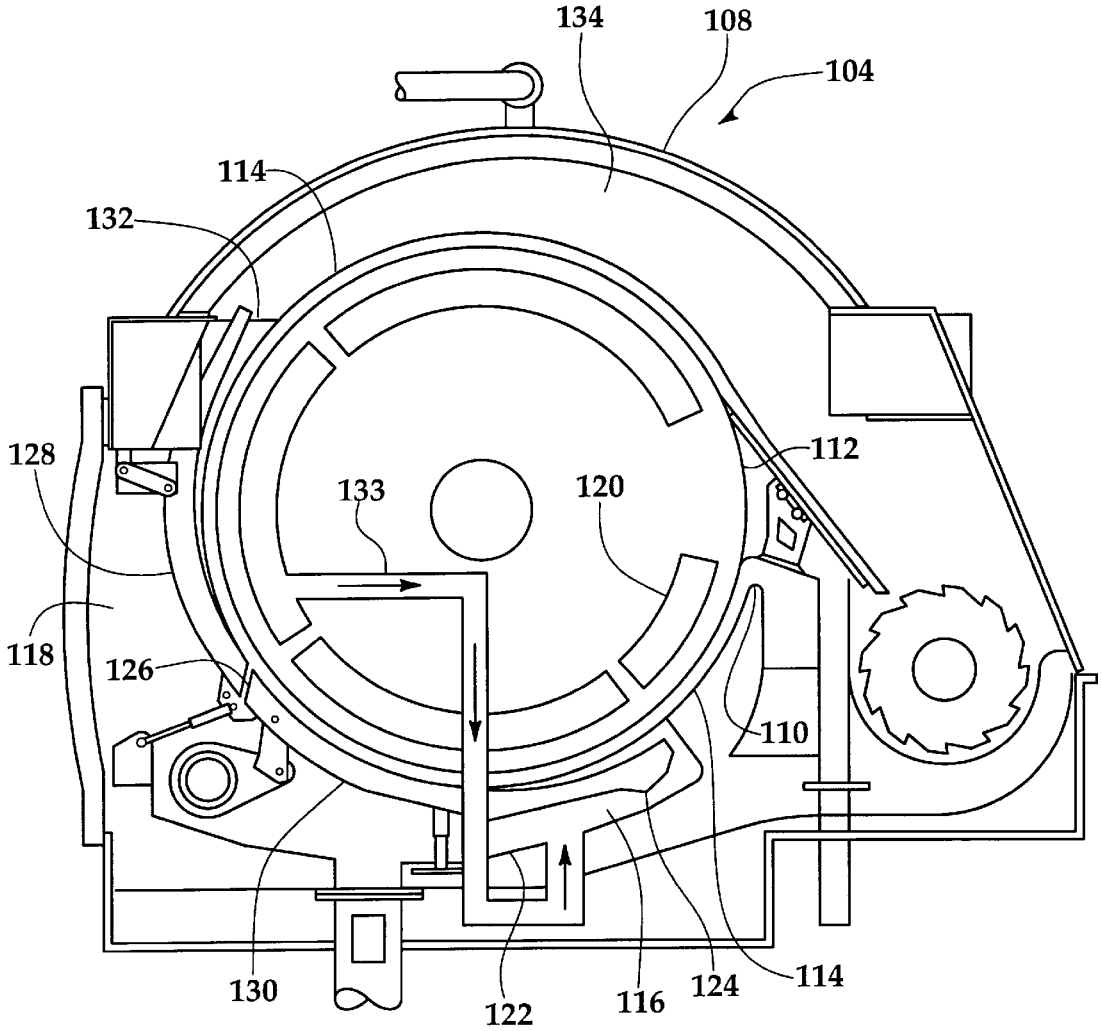
FIG. 6 is a perspective view of an alternative embodiment pulp washer where air pressure is used to move the wash liquid through fiber mat on the drum.

The system of collecting wash fluid through two fluid collection systems connected to receive wash fluid from the same drum sectors but at different times is not limited to vacuum washers 20 as shown in FIG. 2, but can be used in a pressure washer 104 as illustrated in FIG. 6. The drum 106 illustrated in FIG. 6 is contained in a completely sealed enclosure 108 to which air is supplied at a pressure of three to five psi. Drainage systems similar to those shown in FIGS. 2 and 3 are connected through a valve mechanism (not shown) to atmospheric pressure, so that the pressure within the enclosure 108 causes wash water to move alternatively into the two drainage systems.

A pulp feed nozzle 110 supplies pulp having a consistency of four to ten percent or more directly onto the filter screen 112 of the drum 106. The first drainage system (not shown) draws black liquor 120 from the fiber mat 114 immediately following the feed nozzle 110. A series of semi-cylindrical baffles are positioned about the outside of the drum 106 to compact the fiber mat and to define a first wash pond 116, and a second wash pond 118. The first wash pond 116 supplies a first wash liquid 122 to the front of the first pond baffle 124. The first wash liquid 122 passes through the fiber mat and is collected by the first drainage system (not shown) as indicated in FIG. 6. A narrow gap 126 between a third pond compression baffle 128 and a second pond compression baffle 130 allows second stage wash liquid 132 to pass under the second pond baffle 130 and pass through the fiber mat 114. The second wash liquid 132 is collected by a second fluid collection system 133 and supplied to the first wash pond 116. The washer 104 has an air cap 134 which dries the fiber mat 114. Any liquid removed during the drying stage is also collected by the second fluid collection system.

A basically similar machine is described in U.S. Pat. No. 5,046,338 issued Sep. 10, 1991, to Oscar Luthi, which is incorporated herein by reference. Luthi however shows a device with only a single collection system wherein system volume is minimized to minimize mixing between wash water collected from sequential wash stages. The present invention incorporates the Luthi model for constructing a completely flooded washer and adds the principles disclosed herein of two fluid drain systems which sequentially in time drain the same region of washer drum, thereby achieving nearly complete separation between wash liquid extracted from two or more wash regions on a washer drum.

It should be understood that various valve arrangements are known to those skilled in the art for use with rotary drum washers and that these systems could be modified as described herein to create a dual fluid collection system valve mechanism. Typical prior art mechanisms would be to bring a series of tubes against a rotated disk which would have openings to receive fluid from the tubes at selected intervals. By directing two sets of tubes to different diameters on a rotating disk two separate valve fluid collection systems could be created.

It should be understood that wherein a one percent stock solution is described as preferred for a vacuum washer more concentrated stock solutions in the range of four to about ten percent could be used particularly in pressure washers as shown in FIG. 6 and as described with respect to the disclosure of Luthi.

It should be understood that the filter drum described and illustrated herein will typically have a diameter of about three to about four and one-half meters in diameter. And be divided into between about twenty and about seventy sectors with thirty or thirty-six being typical.

Although the twin fluid collection systems described herein may have particular utility in a vacuum type drum washer, pressure washers employing similar principles are also contemplated.

It should be understood that wherein two fluid collection systems are described and illustrated three or more systems could be used so that three or more wash stages could be performed on a single wash drum.

It is understood that the invention is not limited to the particular construction and arrangement of parts herein illustrated and described, but embraces such modified forms thereof as come within the scope of the following claims.

I claim:

1. A pulp drum washer comprising:

a cylindrical shaped drum mounted for rotation about an axis defined by the drum, the drum having a circumferential cylindrical surface;

a multiplicity of adjacent filter sections extending axially across the drum cylindrical surface, a plurality of decks, one of the plurality of decks underlying each filter section and each deck having a radially outwardly facing surface for receiving fluid passing through the filter sections;

partitions extending axially along the cylindrical surface between adjacent filter sections, the partitions forming a barrier to the flow of fluid between filter sections;

a first fluid collection system comprising a multiplicity of first fluid channels, one of the first fluid channels, underlying each deck under each filter section, the first fluid channels communicating in fluid receiving relationship with the upwardly facing surface of the overlying deck along the axial extent of the drum; and a second fluid collection system comprising a multiplicity of second fluid channels, one of the second fluid channels underlying each deck under each filter section, the second fluid channels communicating in fluid receiving relationship with the upwardly facing surface of the overlying deck along the axial extent of the drum.

2. The pulp washer of claim 1 further comprising a means for restricting the flow of liquid through the first fluid collection system to a selected range of circumferential positions through which the drum rotates.

3. The pulp washer of claim 2 further comprising a means for restricting the flow of liquid through the second fluid collection system to a selected range of circumferential positions through which the drum rotates.

4. The pulp washer of claim 1 further comprising a container surrounding at least a lower portion of the drum, the container for holding a supply of paper pulp stock to be cleaned.

5. The pulp washer of claim 1 wherein the rotation of the drum defines a rotation direction, the pulp washer further comprising:

a first shower positioned to supply wash liquid to the surface of a fiber mat formed on the drum;

a second shower positioned to supply wash liquid to the surface of the fiber mat at a position spaced in the direction of rotation from the first shower;

a means for removing the fiber mat positioned downstream from the second shower;

wherein the first shower is in fluid receiving relation with the second fluid collection system to form a two stage countercurrent washer wherein wash liquid from the second shower passes through the fiber mat, is collected by the second fluid collection system and supplied to the first shower.

6. The pulp washer of claim 1 further comprising:

a means for forming a fiber mat on the cylindrical surface of the drum;

a first means for supplying a first wash fluid to the fiber mat;

a second means for supplying a second wash fluid to the fiber mat, the second means being positioned over the drum so that rotation of the drum carries the fiber mat from the first washer to the second washer, wherein the second means for supplying a second wash fluid is in fluid receiving relation with the second fluid collection system;

a means for closing in the first fluid collection system so it does not collect fluid once the second wash fluid has penetrated the fiber mat; and a means for closing in the second fluid collection system so it only collects the second wash fluid after it passes through the fiber mat.

7. The pulp drum washer of claim 1 further comprising:

a first fluid conduit;

a second fluid conduit;

a valve which selectably blocks the first fluid conduit or the second fluid conduit;

first passageways fixed to the drum and rotatable with the drum, the first passageways extending between the first channels and the first fluid conduit; and second passageways fixed to the drum and rotatable with the drum, each second passageway extending between a second channel and the second fluid conduit, wherein the drum rotates about the valve, such that fluid flow from a selected filter section into the first fluid conduit and the second fluid conduit is alternately permitted and prevented.

8. A multistage pulp washer comprising:

a drum mounted for rotation, the drum having a cylindrical surface divided into a plurality of radial sections, each section having a filter screen and a support deck isolated from adjacent sections by axially extending seals, each section having at least two fluid collection systems which can selectively drain fluid through that section;

a means for selecting one of the at least two fluid collection systems and causing fluid to drain through that system, and a means for preventing fluid from draining from the unselected fluid collection system, the means for preventing fluid from draining also selectively preventing draining from the at least two fluid collection systems simultaneously.

9. The multistage pulp washer of claim 8 further comprising a first washing means and a second washing means wherein the first washing means is positioned sequentially along the cylindrical surface the second washing means following the first washing means wherein the means for selecting the one of the at least two fluid collection system is a valve mechanism positioned along the axis of the drum.

10. A washer for papermaking pulp comprising:

a rotatable cylindrical drum having a plurality of adjacent radially extending sectors, wherein a downstream direction is defined in the direction of rotation of the drum;

a container in which the drum rotates, wherein fibers introduced into the container engage the drum to form a mat thereon overlying the sectors;

a first wash liquid station positioned to discharge a first wash liquid onto the sectors of the drum to pass through the mat;

a second wash liquid station positioned downstream of the first wash liquid station to discharge a second wash liquid onto the sectors of the drum to pass through the mat after it has progressed through the first wash liquid station;

a first drainage system extending within the drum to draw away the first wash liquid which has passed through the mat;

a second drainage system extending within the drum to draw away the second wash liquid which has passed through the mat;

portions of a first sector which define a first passageway which is in communication with the first drainage system over less than the entire period of rotation of the drum; and portions of said first sector which define a second passageway which is in communication with the second drainage system over less than the entire period of rotation of the drum, and wherein fluid within said first sector may be selectably drained through the first drainage system or the second drainage system, and wherein each of the sectors is provided with its own first passageway and second passageway, such that fluid drained through each of said first passageways may be collected in the first drainage system, and fluid drained through each of said second passageways may be collected in the second drainage system.

* * * * *